US008082684B2

(12) United States Patent
Munns

(10) Patent No.: US 8,082,684 B2
(45) Date of Patent: Dec. 27, 2011

(54) FOOTWEAR WITH BRIDGED DECOUPLING

(75) Inventor: Jon Munns, Gilroy, CA (US)

(73) Assignee: Fox Head, Inc., Morgan Hill, CA (US)

( * ) Notice: Subject to any disclaimer, the term of this patent is extended or adjusted under 35 U.S.C. 154(b) by 859 days.

(21) Appl. No.: 11/573,856

(22) PCT Filed: Aug. 18, 2005

(86) PCT No.: PCT/US2005/029628
§ 371 (c)(1),
(2), (4) Date: Jun. 20, 2008

(87) PCT Pub. No.: WO2006/023773
PCT Pub. Date: Mar. 2, 2006

(65) Prior Publication Data

US 2008/0289221 A1 Nov. 27, 2008

Related U.S. Application Data

(60) Provisional application No. 60/602,733, filed on Aug. 18, 2004.

(51) Int. Cl.
*A43B 13/00* (2006.01)

(52) U.S. Cl. ..... 36/25 R; 36/102; 36/103

(58) Field of Classification Search ..... 36/25 R, 36/102, 103, 31
See application file for complete search history.

(56) References Cited

U.S. PATENT DOCUMENTS

| | | | | |
|---|---|---|---|---|
| 3,290,801 | A | | 12/1966 | Bente |
| 4,779,361 | A | | 10/1988 | Kinsaul |
| 4,922,631 | A | * | 5/1990 | Anderie ..... 36/102 |
| 5,005,299 | A | | 4/1991 | Whatley |
| 5,012,597 | A | | 5/1991 | Thomasson |
| 5,384,973 | A | | 1/1995 | Lyden |
| 5,408,761 | A | | 4/1995 | Gazzano |
| 5,440,826 | A | | 8/1995 | Whatley |
| 5,647,145 | A | | 7/1997 | Russell et al. |

(Continued)

FOREIGN PATENT DOCUMENTS

AU 2005277218 3/2009

(Continued)

OTHER PUBLICATIONS

PCT International Search Report and PCT Written Opinion dated Dec. 15, 2005 for International PCT Application No. PCT/US05/29628 filed Aug. 18, 2005, 5 pages.

(Continued)

*Primary Examiner* — Marie Patterson
(74) *Attorney, Agent, or Firm* — Ganz Law, PC

(57) ABSTRACT

A sole unit for a shoe having at least one decoupling track between regions of sole unit allowing for the decoupling of the regions in response to forces from foot-ground contact; a plurality of bridge elements connecting opposite sides of the track so that when forces from foot-ground contact are alleviated, there is a recouping of the decoupled regions. The bridge elements may extend from a tendon element disposed on one side of a decoupling track to the other side of the track.

29 Claims, 7 Drawing Sheets

U.S. PATENT DOCUMENTS

| | | | | |
|---|---|---|---|---|
| 5,784,808 | A * | 7/1998 | Hockerson | 36/102 |
| 5,810,764 | A | 9/1998 | Eggers et al. | |
| 6,065,230 | A * | 5/2000 | James | 36/25 R |
| 6,115,945 | A * | 9/2000 | Ellis, III | 36/102 |
| 6,338,206 | B1 | 1/2002 | Kita | |
| 6,389,713 | B1 | 5/2002 | Kita | |
| 6,401,365 | B2 | 6/2002 | Kita et al. | |
| 6,438,870 | B2 | 8/2002 | Nasako et al. | |
| 6,647,645 | B2 | 11/2003 | Kita | |
| 6,748,675 | B2 | 6/2004 | Sato | |
| 6,962,008 | B2 * | 11/2005 | Manz et al. | 36/25 R |
| 6,990,755 | B2 * | 1/2006 | Hatfield et al. | 36/97 |
| 7,124,519 | B2 * | 10/2006 | Issler | 36/31 |
| 7,171,767 | B2 * | 2/2007 | Hatfield et al. | 36/97 |
| 7,392,605 | B2 * | 7/2008 | Hatfield et al. | 36/97 |
| 7,430,817 | B2 * | 10/2008 | Abadjian et al. | 36/29 |
| 7,441,346 | B2 * | 10/2008 | Hardy et al. | 36/25 R |
| 7,627,963 | B2 * | 12/2009 | Kilgore | 36/97 |
| 2002/0088145 | A1 | 7/2002 | Clark et al. | |
| 2002/0144429 | A1 | 10/2002 | Hay | |
| 2004/0154188 | A1 | 8/2004 | Laska | |

FOREIGN PATENT DOCUMENTS

| | | |
|---|---|---|
| CA | 2577344 | 10/2010 |
| EP | 0836395 | 4/1998 |
| EP | 0873061 | 10/1998 |
| JP | 2000189205 | 7/2000 |

OTHER PUBLICATIONS

European Office Action dated Mar. 17, 2011,which issued in counterpart related European Application No. 05 786 806.9-2318, (5 pages).

European Search Report dated Feb. 2, 2009, 5 pages.

Canadian Office Action for co-pending Canadian Patent Application No. 2,577,344, dated Jun. 19, 2009, 1-4.

Canadian Office Action dated Sep. 24, 2008, pp. 1-3.

Response to Office Action submitted to the European Patent Office for European Patent Application No. 05786806.9-2318, dated Nov. 13, 2009; 17 pages.

Response to Office Action submitted to the Australian Patent Office for Australia Patent Application No. 2005277218, dated Nov. 4, 2008; 34 pages.

Response to Office Action submitted to the European Patent Office for European Patent Application No. 05786806..9-2318, dated Jul. 13, 2011; 12 pages.

Response to Office Action submitted to the Canadian Patent Office for Canadian Patent Application No. 2577344, dated 12/1612009; 7 pages.

Response to Office Action submitted to the Canadian Patent Office for Canadian Patent Application No. 2577344, dated Mar. 24, 2009; 26 pages.

Office action dated Feb. 19, 2008 from Australian Patent Office for Australia Patent Application No. 2005277218; 2 pages.

Office Action from European Patent Office for European Patent Application No. 05786806.9-2318, dated Jul. 13, 2009; 1 page.

* cited by examiner

FOOTWEAR WITH BRIDGED DECOUPLING

RELATED APPLICATIONS

This invention claims the benefit of U.S. Provisional Application No. 60/602,733, entitled FOOTWEAR WITH BRIDGED DECOUPLING, filed on Aug. 18, 2004, the entire disclosure of which is hereby incorporated by reference and set forth in its entirety for all purposes.

BACKGROUND OF THE INVENTION

This invention relates to footwear, and in particular to an article of footwear with a cushioning system to protect the wearer from impact combined with a stability system to protect the wearer from uncontrolled motion. It is particularly suited for athletic footwear adapted to accommodate the dynamic motions of the leg, ankle, and foot when walking, running, biking, jumping, turning, and so on. Accordingly, to illustrate the principles of the inventive concepts, it will be described in terms of athletic shoes such as, but not limited to, running, training, walking, and court shoes.

The gait cycle is the repetitive sequence of events that occur during walking or running. Taking heel contact of one foot as the starting event, the stance phase starts with heel contact and ends with toe-off, and the swing phase starts with toe-off and ends with the next heel contact. The stance phase encompasses the period of contact between the foot or footwear and the ground. The swing phase creates the distance traveled during each step.

Throughout the gait cycle, the foot, ankle, and leg anatomy undergo a complex series of three-dimensional motions ultimately governed by the physics of upright bipedal gait. At heel strike, the foot flexes slightly (pronation) to absorb energy and cushion impact. By toe-off, the foot has stiffened (suppination) to push tire body forward. Pronation and suppination have protective and functional benefits. Pronation, for example, cushions the body from impact—but over-pronation can promote certain tendon and knee injuries, among other problems. Suppination provides a rigid platform for push-off—but over-suppination can promote stress fractures and twisted ankles, among other problems. The alternation between pronation and suppination represents an elegant natural solution to the paradoxical "design goals" underlying the role of the foot in weight bearing, locomotion, and equilibrium. The anatomical details are beyond the scope of this discussion and well known in the science of biomechanics.

Shoes are functional extensions of the feet. A shoe supplements the natural mechanisms of the foot to augment its ability to achieve efficient propulsion and protect the body from injury. Just as the foot faces apparently contradictory "design goals," so too do shoes. An ideal shoe should provide cushioning and shock absorption to protect the wearer. Too much softness, however, can yield a shoe with insufficient foot and ankle stability, potentially contributing to injuries from over-pronation, over-suppination, or excessive foot motion (twisted ankles, say). An ideal shoe should somehow manage to mimic the behavior of the foot, combining softness at impact and stiffness at push-off, while also providing support throughout the gait cycle. Taking inspiration from the foot itself, an ideal shoe should dynamically control the transition from cushion to rebound in both the lateral (side-to-side) and longitudinal (toe-to-heel) dimensions of the shoe. Unfortunately, these objectives are not adequately addressed in conventional shoes, which typically have foot-supporting, sole units that behave monolithically relative to certain foot features of the foot anatomy and do not allow for the natural movement of such anatomy.

SUMMARY

The inventive concepts described herein overcome problems in the prior art by providing an athletic shoe with the following qualities, alone or in combination:

- Means of decoupling selected, adjacent regions or zones of the sole of a shoe, to reduce transfer of motion, force, or stress between the decoupled regions, by providing grooves molded, cut, or otherwise formed in the midsole, outsole, or both.
- Means of controlling and stabilizing the relatively independent motions of the decoupled regions or zones, by providing elastomeric bridges across a decoupling groove.
- Means of cushioning, controlling, and stabilizing the shoe in the longitudinal direction, by providing one or more elastomeric tendons attached to the midsole, outsole, or both and bridging the rearfoot, midfoot, and forefoot in any combination.
- Means of dampening impact forces by providing a plurality of tunnel-like voids in the midsole, accomplished by embedding at least one formed piece (a dampener) in the midsole.
- Means of dampening impact forces in each decoupled region independently, by selecting or omitting a dampener or dampeners for each decoupled region according to the particular purpose of the shoe.

In certain embodiments, the inventive concepts described herein contemplate a sole unit for a shoe comprising a sole unit having at least one decoupling track between regions of sole unit allowing for the decoupling of the regions in response to forces from foot-ground contact; a plurality of bridge elements connecting opposite sides of the track so that when forces from foot-ground contact are alleviated, there is a recoupling of the decoupled regions.

In certain embodiments, the inventive concepts described herein contemplate a sole unit comprising at least one decoupling groove provided in the sole unit; and at least one tendon having a plurality of extending bridge elements elastically connecting opposite sides of the decoupling groove.

In certain embodiments, the inventive concepts described herein contemplate a sole unit for a shoe, comprising a sole unit having a decoupling track between regions of sole unit allowing for the decoupling of the regions in response to forces from foot-ground contact; and a tendon for control of forces along at least a section of the decoupling track.

In the foregoing embodiments: the decoupling track may follow a path that creates lateral-medial decoupling of a heel region and/or a path that creates lateral-medial decoupling of a forefoot region. The sole unit may include a tendon for force control wherein the bridge elements have first ends connected to the tendon, the tendon having at least one section disposed substantially along one side section of the decoupling track and the bridge elements extend from the tendon and are connected to the opposite side of the section of the decoupling track. The tendon may extend along one or more decoupling tracks in a heel region and a forefoot region. A tendon may comprise a curvilinear element that follows one or more curvilinear decoupling tracks disposed substantially longitudinally in at least a heel region or forefoot region. The tendon element and one or more associated decoupling tracks may be disposed in at least a heel region and/or a forefoot region and decouple the heel and forefoot regions into lateral and medial sides. The tendon and bridges may be disposed between layered portions of a midsole and outsole. The midsole portion may be selected from a material or structure comprising one or more of EVA, Polyurethane, and a fluid filled compartment, and the outsole material comprises a rubber or elastomer suitable for use in an athletic shoe. A dampening element may be associated with at least one of the decoupled sole unit regions. A tendon may elastically connect the rearfoot, midfoot, and/or forefoot. The tendon may be a separate piece of elastomeric material affixed to a portion of the outsole, midsole, or both. The tendon may be an integral part of the outsole, midsole, or both.

The inventive concepts described herein may be implemented using known manufacturing techniques well within the skill of persons in the art. They may also be implemented in shoes having conventional uppers attached to the inventive sole units.

The foregoing is not intended to be an exhaustive list of embodiments and features of the inventive concepts. Persons skilled in the art are capable of appreciating other embodiments and features from the following detailed description in conjunction with the drawings.

BRIEF DESCRIPTION OF THE DRAWINGS

FIGS. 1 through 6 show representative embodiments of the inventive concepts, wherein similar features share common reference numerals.

FIG. 1 is a side view of a shoe constructed in accordance with the principles of the inventive concepts;

FIG. 2 is a bottom view thereof, retaining outsole detail to illustrate the full context of the inventive concepts;

FIG. 4A is top view of a representative tendon element in accordance with the principles of the inventive concepts;

FIGS. 4B and 4C are top views of alternative bridge embodiments;

FIG. 5A is a variation of FIG. 3A, adding a tendon element to show the tendon element bridging a decoupling groove;

DETAILED DESCRIPTION

Figure 1:
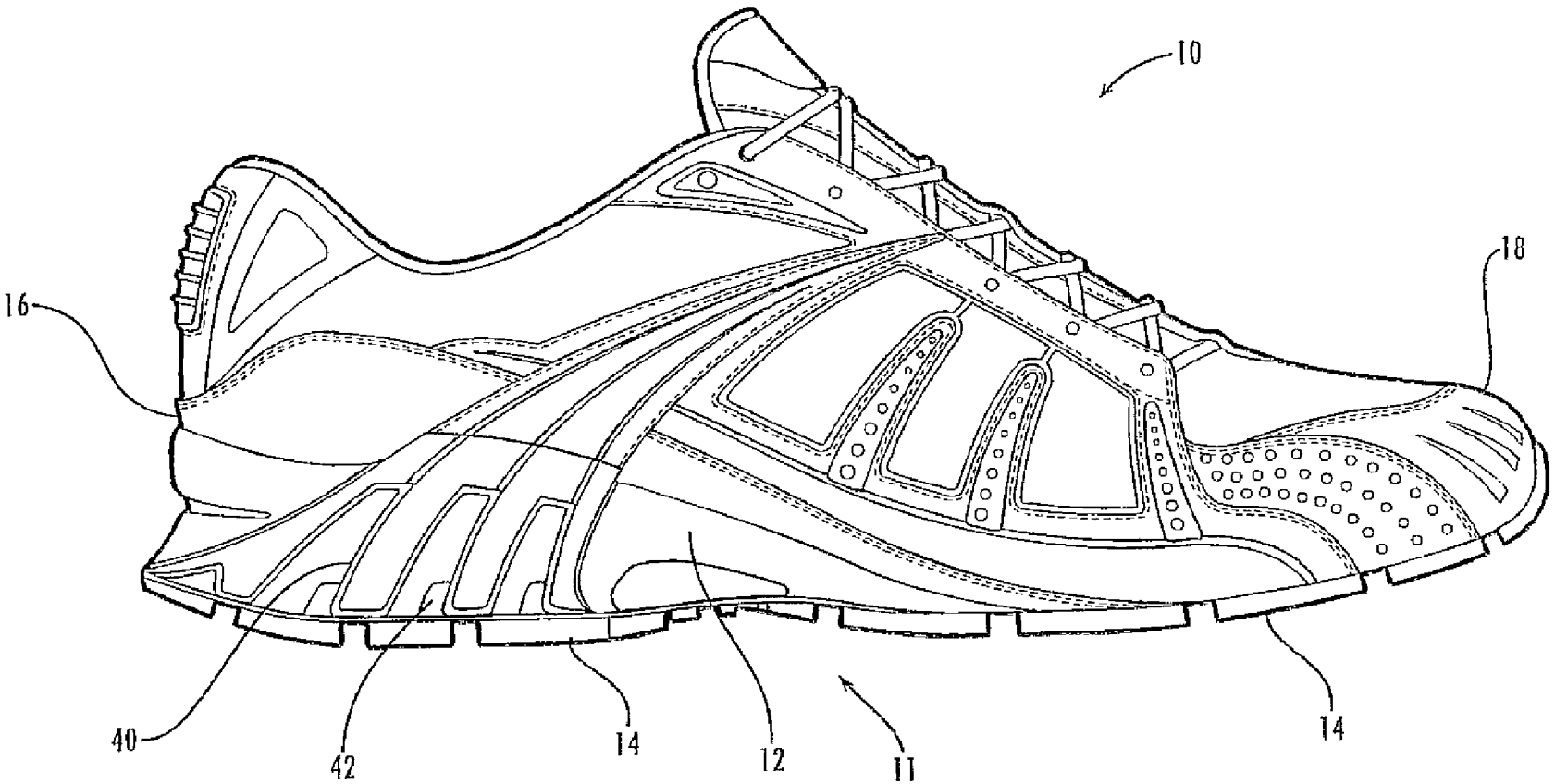

The inventive concepts are an architecture for a sole unit for a shoe where the sole unit combines a decoupling mechanism that permits selected, adjacent regions (or zones) of the sole to move with a specifiable amount of independence with a control mechanism that constrains the decoupled regions in a separately specifiable manner. Some embodiments have one or more dampening elements to modify the cushioning properties of the midsole. Each decoupled region can have its own dampening element, in order to independently modify the cushioning properties of each decoupled region.

The inventive concepts accomplish the decoupling by providing one or more decoupling tracks that, for example, are molded into, excised, from the midsole, outsole, or both. The shoe preferentially flexes along the groove or grooves to allow each side a selected amount of independent motion. The degree of independence depends on the location, depth, shape, and other properties of the groove or grooves and on the physical properties of the midsole, outsole, heel counter, and other parts of the shoe. The purpose of a given shoe influences the decoupling properties selected for it. The decoupling requirements of a running shoe differ from those of a court shoe, for example, because the former is adapted to straight-line motion while the latter is adapted to abrupt lateral changes of direction.

In certain embodiments, the inventive concepts accomplish lateral constraint by providing a resilient tendon element that spans the decoupling grooves with a plurality of elastic cross-connections called bridges. These bridges stretch to absorb energy when forces acting on the shoe cause, for example, an expansion or bending at a decoupling groove, transferring the force across the associated bridges. The bridges provide a return energy, helping the foot and shoe to resiliently return to their original shape later in the gait cycle when the forces acting on the groove are alleviated. By their resilience, resistance, and shape-memory, the bridges modify the tendency of the shoe to preferentially flex along its decoupling grooves. Bridges thus provide a separately specifiable control force contributing to the stability of the shoe. The amount, direction, response curve, and other properties of the control force depend on, for example, the number, location, thickness, and cross-sectional profile of the bridges and on the elastomeric material used to fabricate them. The purpose of a given shoe influences the type and amount of control force selected for it. It will be appreciated from the foregoing that the return energy or resilience of the sole unit along a groove may be achieved even if the tendon or bridges are not themselves of an elastomeric or resilient nature. For instance, the bridges may have a firmer, more inelastic nature than the material that bridges interconnect to and the interconnected sole material may be elastic and resilient so that tension occurs across the bridge element. If the bridge element is inelastic it can have a length that is greater than the width of the groove (for example, using accordion pleats), allowing the groove to separate just as an elastic bridge element would allow.

Separately specifying the decoupling and recoupling parameters permits dynamic control over the shoe through the gait cycle, for example, during the transition from cushion to rebound. A midsole fabricated from a uniform material such as ethylene vinyl acetate, polyurethane, or similar foam-rubber-type compounds tends to exhibit a substantially linear response to flexing forces. Introducing one or more decoupling grooves biases the shoe to bend along a particular flex axis or axes. The bridges—fabricated from a distinct material with separately specifiable properties—permit a combined force-flex profile unavailable from uniform construction. Elastic materials can exhibit non-linear responses under changing tension and can therefore offer a dynamic resistance when stretched by different amounts. The interaction between a linear compliance in one direction and a non-linear counterforce in the other direction governs the dynamic behavior of the shoe throughout the gait cycle.

Figure 5H:
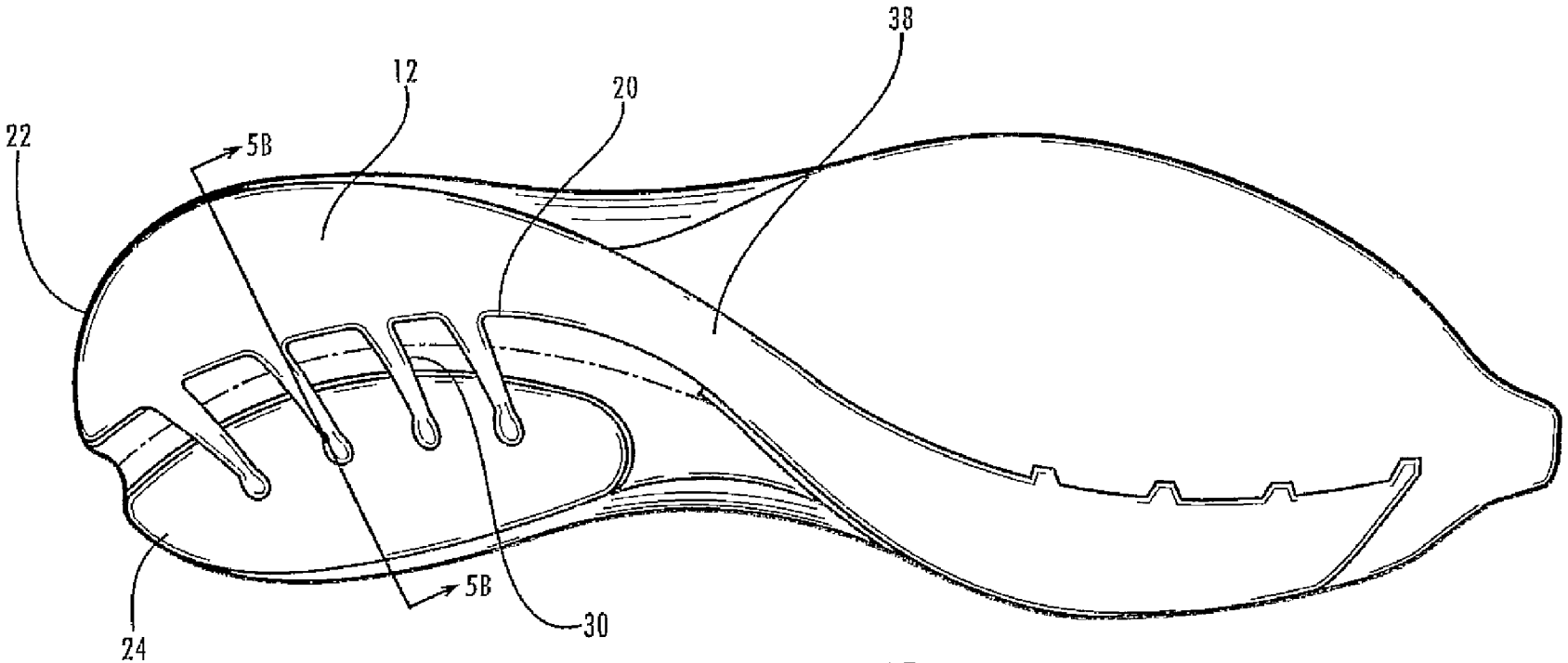

In some embodiments, the tendon may extend lengthwise along the sole, providing a longitudinal cushioning and rebound effect based on the dampening properties inherent in elastomeric materials. For example, for a tendon element that is disposed from a lateral heel, across a midfoot, to a medial forefoot, as shown in FIG. 5A, as the foot lifts at midstride, the tendon stretches lengthwise, absorbing impact energy and moderating its effect. Later, when the shoe returns to its unstressed shape, the tendon contracts, releasing the absorbed energy and improving stride efficiency through rebound. The tendon provides a lengthwise control force contributing to the stability of the shoe.

Some embodiments of the inventive concepts have at least one dampening element either by itself or in combination with decoupling grooves, bridges, or both. A dampening element according to certain inventive concept comprises a plurality of tunnel-like voids that pass into the midsole, for example, at the heel, aligned in the lateral-medial direction and parallel to the plantar plane. The tunnels result from embedding a formed dampener, typically fabricated from thermoplastic, into the midsole. The voids may be filled with air or other material. The presence of a dampener modifies the impact-absorbing properties of the midsole. Each decoupled region may have its own dampener or dampeners, allowing each region to have a distinct and independent amount of dampened cushioning, specified region-by-region according to the particular purpose of a shoe.

One contemplated location for bridged decoupling is the rearfoot at the heel of the shoe. During the gait cycle, the foot typically strikes the ground somewhere on the heel. The exact point of impact can vary due to biomechanical differences between persons, irregularities of the impact surface, and other factors. For any given step, the striking point might fall on the lateral, central, or medial heel. To decouple the medial heel from the lateral heel, a shoe according to the principles of the inventive concepts has at least one decoupling groove running substantially longitudinally through the midsole, outsole, or both to divide the heel into medial and lateral regions. At heel strike, the groove or grooves allow the shoe to preferentially flex along the groove axis. This particular decoupling allows the shoe to absorb a lateral or medial heel strike while limiting the transfer of forces to the non-striking side. If the strike is lateral, for example, then this decoupling groove allows the lateral heel to flex in response to the impact while minimizing motion transferred through the shoe to the medial heel. The rest of this description illustrates the invention through an embodiment with lateral-medial decoupling at the heel. Bridged decoupling at other locations, such as the forefoot, midfoot, or both, is within the scope of this invention.

As used throughout, "shoe" refers to footwear generally and includes shoes per se as well as sandals, boots, and other articles of footwear. "Sole unit" refers to the parts of a shoe under the foot, which may comprise an insole, midsole, and outsole, and which may extend under all or part of the foot. "Insole" refers a layer of material inside the shoe, adjacent to the foot or sock. "Midsole" refers to a layer of material between the insole and outsole, typically made from a foam-rubber-type compound to provide cushioning. "Outsole" refers to a layer of material at the bottom of the shoe, in contact with the ground, and typically made from a hard carbon rubber or similar materials selected for durability and traction.

"Decoupling grooves" are channels molded, cut, or otherwise formed in the outsole, midsole, or both to allow the shoe to preferentially flex along the decoupling groove axis or path. The groove or grooves allow the sole region on one side of a groove to move with a specifiable amount of independence relative to the sole region on the other side, thereby reducing the transfer of motion, force, and stress from one side to the other side. It will also be appreciated by persons skilled in the art that a groove need not be in the nature of a physical depression inset into the sole, but it may also be a virtual groove where material properties or structures define a flexion line. For example, decoupling groove 20 could be substantially coplanar with its adjacent regions of sole unit but be made of a more elastic material than the adjacent regions so that those regions can react to force independently and decouple. Similarly, the groove could be a coplanar structure designed to flex, bend or collapse under force more easily than the adjacent regions, also allowing the regions to react independently to force. For example, accordion or pleated structures, perforated zones, or varying material thicknesses can create a stress risers and consequently flexion lines. Accordingly, the use of the term groove herein is intended to be exemplary and not limiting of a defined track between regions of sole unit that are designated for independent operation, such as decoupling. Hereinafter, the term "decoupling track" may be used to refer to any means of decoupling, including decoupling based on grooves, material properties, and structures.

"Bridges" are cross-connections that join the two sides of a decoupling groove to constrain the motion of the decoupled regions in a separately specifiable manner. The bridges therefore supply a counterforce that modifies the flexibility of the shoe along a defined track on a sole unit. This combination of decoupling grooves with bridges protects the wearer against excessive impact forces, for example at heel strike, while also stabilizing the footwear and foot throughout the gait cycle.

"Forefoot" refers to the distal region of the foot, above and including the ball of the foot and comprising the metatarsals and toes. "Midfoot" refers to the intermediate region of the foot, between the hindfoot and forefoot and comprising the navicular, cuboid, and cuneiform bones. "Hindfoot" is the proximal region of the foot, including the heel, and comprising the talus and calcaneus bones.

Figure 2:
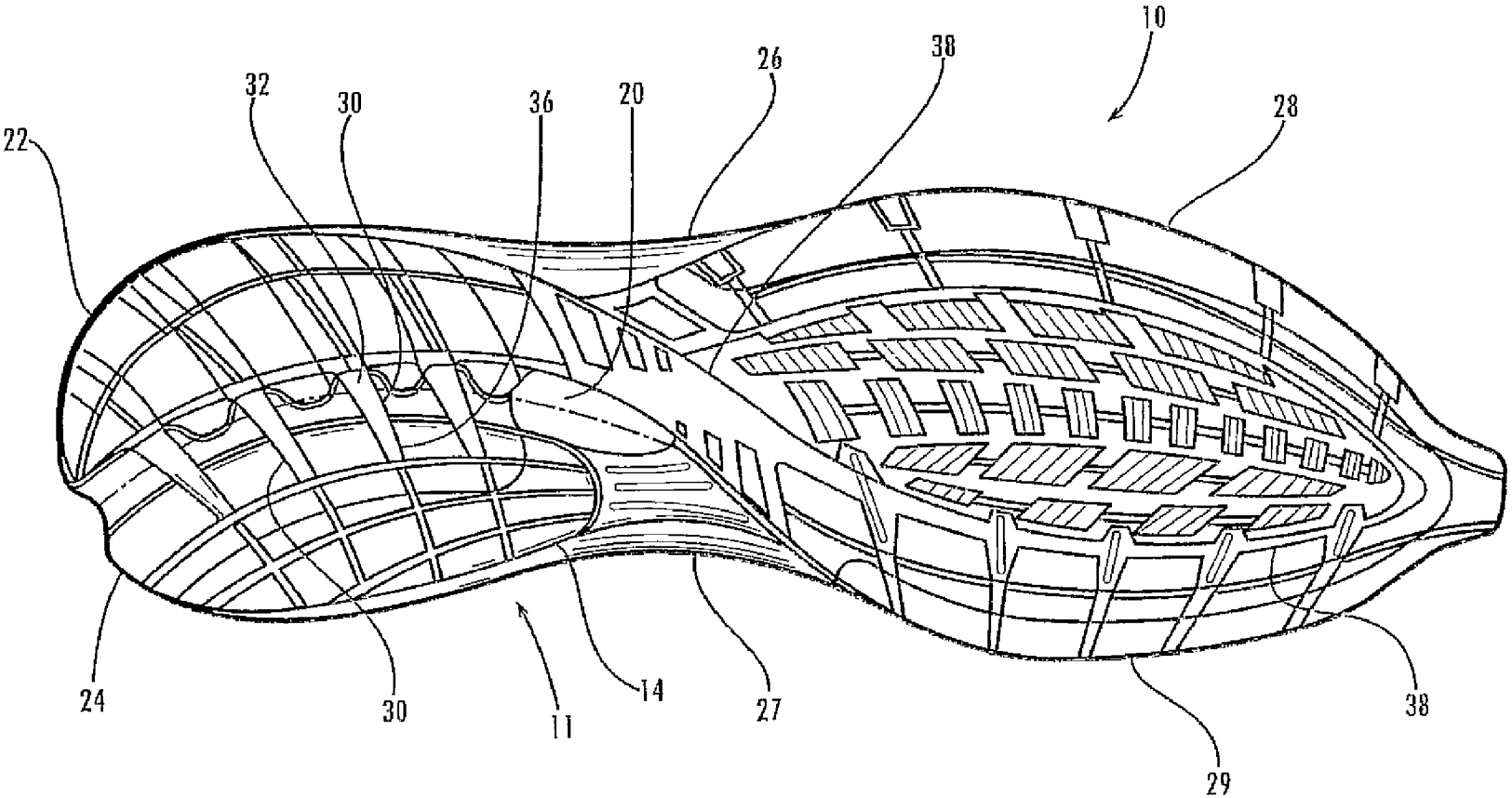

Referring to FIGS. 1 and 2, shoe assembly 10 includes a sole unit 11 having a midsole 12, outsole 14, heel counter 16, and toe box 18. As persons skilled in the art will appreciate, not all of these components are necessary, and shoes may have more or fewer components.

Figure 3A:
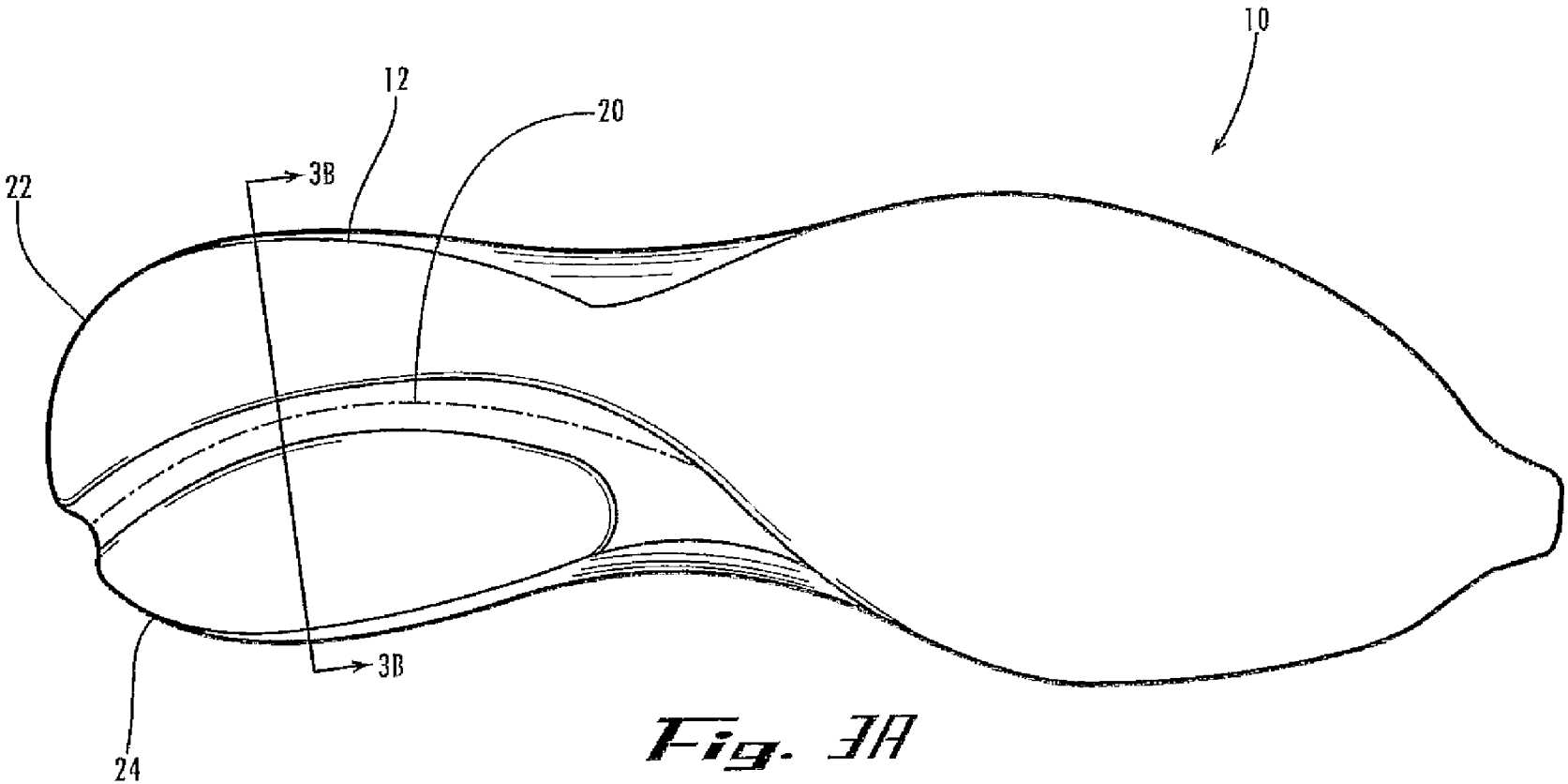
FIG. 3A is a bottom view thereof, eliminating outsole and bridging details to isolate a representative decoupling groove.
Figure 3C:
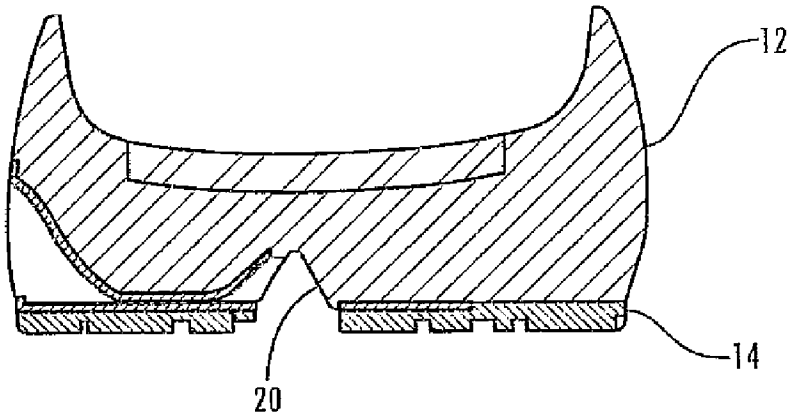
FIG. 3C is a cross-sectional view of the midsole thereof; including the outsole.
Figure 3B:
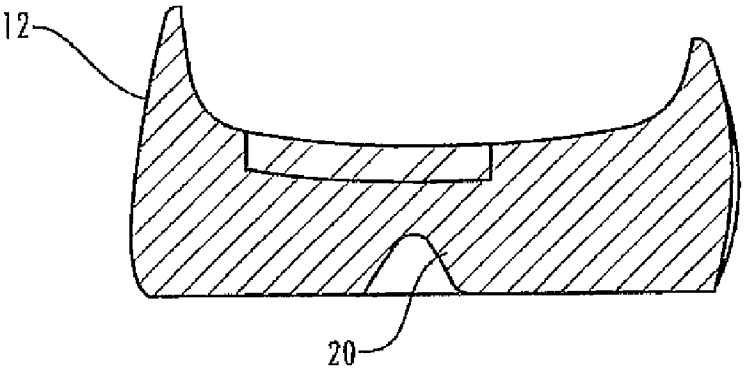
FIG. 3B is a cross-sectional view of the midsole thereof, omitting the outsole.

Referring also to FIGS. 3A, 3B, and 3C, decoupling groove 20 is a channel provided in midsole 12 and outsole 14 to isolate lateral heel 22 from medial heel 24. During walking, running, or oilier activity, decoupling groove 20 allows the lateral heel 22 to move relatively independently from medial heel 24. If heel strike falls on lateral heel 22, then lateral heel 22 can move as a distinct region to respond to the heel strike and absorb the impact. This preferential flexing along decoupling groove 20 limits the transfer of motion through the shoe to the non-striking medial heel 24. In other embodiments, decoupling groove 20 might separate lateral midfoot 26 from medial midfoot 27; or lateral forefoot 28 from medial forefoot 29; or combinations thereof, alone or in combination.

Decoupling groove 20 does not totally isolate lateral heel 22 from medial heel 24, however. Ignoring bridges 30 for now, the amount of flexibility depends on the location, depth, shape, and other properties of decoupling groove 20 and on the physical properties of midsole 12, outsole 14, heel counter 16, and other shoe parts. For example, deeper grooves tend to increase the degree of independence, other things being equal. The particular purpose of a given shoe influences the type and amount of decoupling selected for it. For example, the decoupling requirements of a marring shoe, adapted for straight-line motion, differ from those of a court shoe, adapted to abrupt lateral changes of direction.

The crescent shape, heel location, and medial-lateral separation shown in FIGS. 2 and 3A are exemplary only. Contemplated embodiments suitable for particular purposes include, for example, multiple decoupling grooves, discontinuous decoupling grooves, linear or curved groove shapes, various cross-sectional profiles, any angular alignment, and placement anywhere along the sole. Typical fabrication methods include molding, excising, or otherwise forming a channel into the midsole, outsole, or both.

Figure 4H:
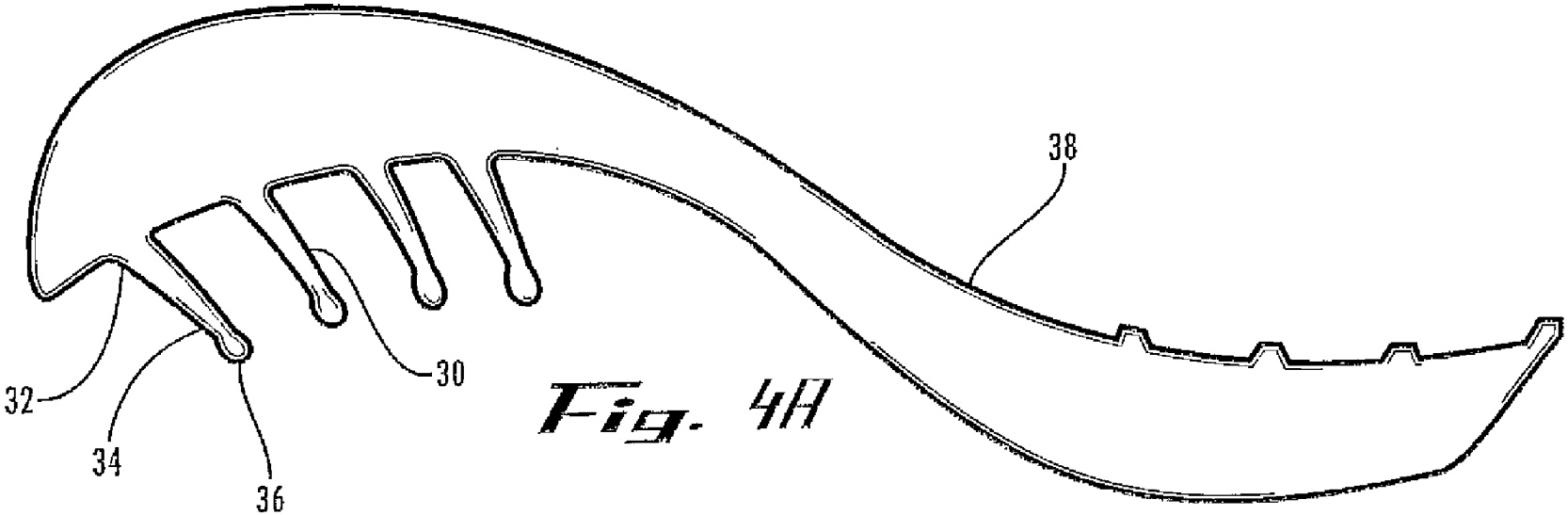
Figure 4I:
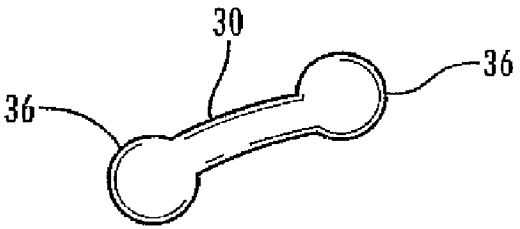
Figure 4G:
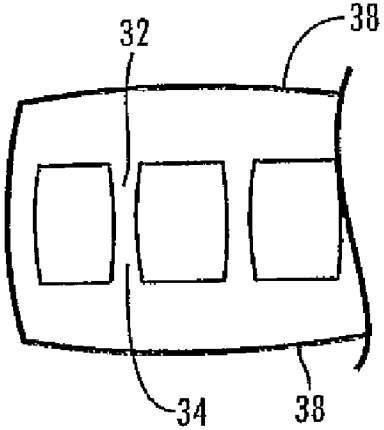

Referring to FIGS. 4A-4C, tendon 38 may be a strip of elastomeric material that provides a plurality of finger-like extensions called bridges 30. The shape of tendon 38 and the location and arrangement of the bridges 30 are contrived so that in the assembled shoe each bridge 30 crosses a decoupling groove 20 to cross-connect the otherwise decoupled regions. Since the tendon, at least in part, will generally follow a decoupling track, the bridges are generally oriented transversely to the section of the tendon following the decoupling track so that the bridges span the decoupling track. Each bridge 30 has a first end 32 and a second end 34. The first end 32 is affixed to one side of decoupling groove 20, and the second end 34 is affixed to the other side of decoupling groove 20. In some embodiments, the first end 32 of a bridge emanates from tendon 38 and the second end 34 terminates in a pad 36 (discussed in more detail below), as shown in FIG. 4A.

Looking at FIG. 4B, for example, in some embodiments, first end 32 emanates from a tendon 38 and second end 34 also merges into a tendon 38 (or other structure), yielding a ladder-like shape with a tendon 38 on both sides of each bridge 30. To facilitate production assembly it may be advantageous to interconnect second ends 34 along the lines shown in FIG. 4B, even if the interconnected ends merge into a structure that does not function as a tendon.

In some embodiments, a bridge 30 is a free structure not associated with a tendon, as shown in FIG. 4C.

Still looking at FIGS. 4A-4C, first end 32, second end 34, or both may include a pad-like extension or anchoring structure 36, typically sandwiched between midsole 12 and outsole 14, to facilitate attachment, for example, by distributing stresses or by providing a larger gluing surface.

FIGS. 2 and 5A show multiple bridges 30 spanning a decoupling groove 20 that separates lateral heel 22 from medial heel 24, and these bridges 30 are affixed to both lateral heel 22 and medial heel 24. Contemplated methods for affixing the ends 32, 34 to midsole 12, outsole 14, or both include adhesives, bonding agents, welding, molding, composite molding, direct injection molding, co-molding separate materials, one-time molding, interlocking shapes, or mechanical bonding, all known in the art, and alone or in combination.

Figure 5B:
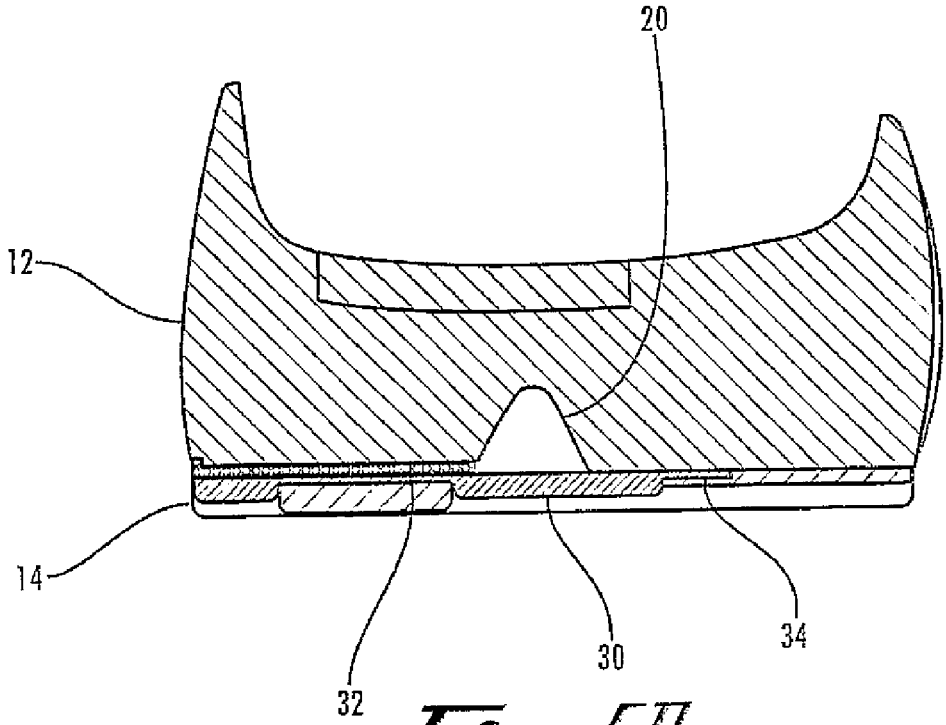
FIG. 5B is a cross-sectional view of the midsole thereof.

Referring to FIGS. 5A and 5B, bridges 30 are elastic members that span a decoupling groove 20 and are attached on both sides. Bridges 30 therefore create a cross-connection that provides a dynamic control force in response to forces applied to the shoe during the gait cycle. As the edges of a decoupling groove 20 pull apart, they apply tension to bridges 30, which therefore stretch, absorbing energy and creating a compensating resistance.

For example, referring the embodiment shown in FIG. 5A, a lateral heel strike flexes the shoe along decoupling groove 20, which is configured to isolate lateral heel 22 from medial heel 24. Lateral heel 22 therefore pulls away from medial heel 24. This change in separation applies tension to bridges 30, which stretch in the medial-lateral direction while absorbing energy from the heel strike. Through their elasticity, bridges 30 resist the forces that are pulling lateral heel 22 away from medial heel 24. The strength, direction, and "response curve" of this counterforce depend on the details of bridge material and structure such as, but not limited to, the number, location, thickness, and cross-sectional profile of bridges 30. For example, thicker bridges tend to increase the amount of force recoupling the opposite sides of a decoupling groove 20. Elastomeric materials can exhibit shape-memory properties, allowing biased or pre-stressed counterforces. The purpose of a given shoe influences the type and amount of control force selected for it.

Later in the gait cycle, as the shoe returns to its unstressed shape, the elastomer snaps back, releasing the stored energy. This storage-and-release cycle offers two benefits. During storage, the resisting force contributes to cushioning. During release, the resilience contributes to the efficiency of the shoe.

In some embodiments, the tendon 38 extends lengthwise along the sole, providing an elastic connection between the hindfoot, midfoot, or forefoot, in any combination. This lengthwise connection provides a longitudinal cushioning and rebound effect. At impact, tendon 38 stretches lengthwise, absorbing impact energy and moderating its effect. Later in the gait cycle, tendon 38 contracts to its unstressed shape, releasing the energy absorbed at impact during the propulsive phase.

In some embodiments, tendon 38 is a separate part molded, cut, or otherwise formed from a distinct material or materials selected for appropriate properties. A contemplated tendon material is thermoplastic urethane (TPU), but other elastomers known in the art and suitable for the purpose include without limitation TPR, BASF Elastalon, Hytrel, Pebax, PVC, Nylon and its derivatives, and rubber and its synthetic and natural derivatives. Contemplated methods for affixing tendon 38 to midsole 12, outsole 14, or both include adhesives, bonding agents, welding, molding, composite molding, direct injection molding, co-molding separate materials, one-time molding, interlocking shapes, or mechanical bonding, alone or in combination, and all known in the art. Outsole 14 may partly or wholly cover up tendon 38, so that only parts of tendon 38 remain externally visible. In other embodiments, tendon 38 and bridges 30 can be an integral part of midsole 12, outsole 14, or both, and not a separate part attached to or embedded within sole unit 11. The use of an integral tendon does not exclude the use of a separate tendon. Embodiments that employ both integral and separate tendons in a single shoe are within the scope of the inventive concepts.

Figure 6A:
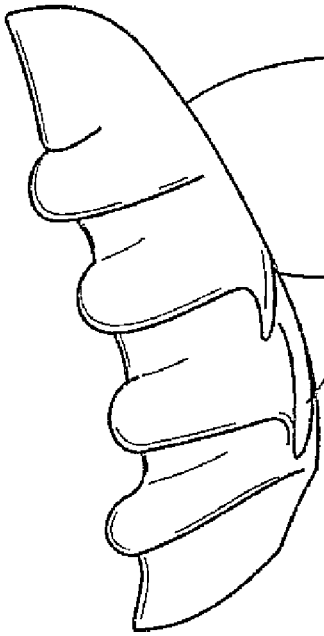
FIG. 6A shows a top view of a dampening element constructed according to the principles of the inventive concepts.
Figure 6B:
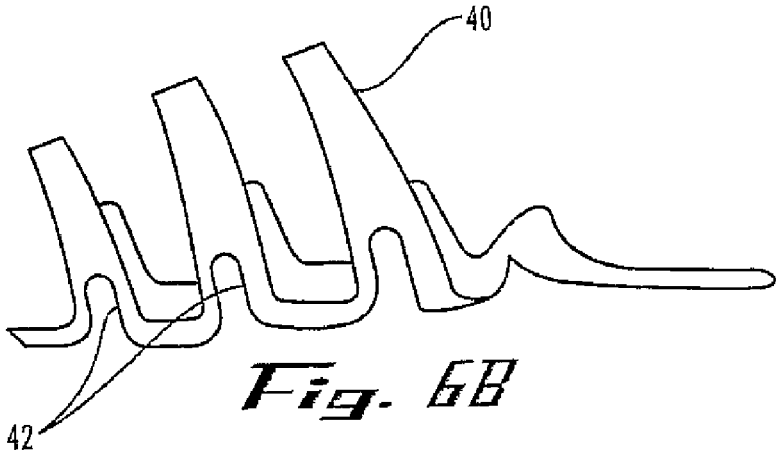
FIG. 6B shows a side view thereof.

Referring to FIG. 6, some embodiments of the inventive concepts additionally include at least one dampener 40 to modify the cushioning properties of the midsole 12. Dampener 40 is a formed part embedded into the midsole 12, or molded therein, to create a plurality of tunnel-like voids 42 that pass into the midsole 12. Dampener 40 is fabricated from a material with dampening or slow-return memory properties. Dampener 40 can be manufactured and assembled alone or in combination with molding, injection molding, direct-injection molding, one-time molding, composite molding, insert molding, co-molding separate materials, adhesives, bonding agents, welding, mechanical bond, or interlocking shapes.

Benefits of providing one or more dampeners 40 include the ability to control cushioning via dampener structure and materials and to reduce the weight of the shoe. Contemplated variations include the location, number, and cross-sectional profile of tunnels 42 as well as the physical properties of the dampener 40 as determined by its materials and structure.

Each decoupled region may have its own dampener 40 (or multiple dampeners 40). As described above, decoupling divides the sole into separate, specific functional zones, and each zone plays a distinct role during the gait cycle. Selectively providing or omitting one or more dampeners 40 for each zone helps to optimize each zone for its role in the gait cycle by tuning its material properties to its functional role. For example, the selection of dampeners 40 can make a given zone firmer or softer, or more energy-absorbent (dampening) or energy-returning (springy), or any combination thereof, than an adjacent zone. A zone-by-zone approach to dampening helps to tune the footwear for various activities (miming, court, track and field, and so on) and their inherent dynamic requirements as well as the variances of the biomechanical abilities of the athletes themselves (pronation, suppination, and so on).

One contemplated location for dampener 40 is the lateral heel of the shoe, aligned in the lateral-medial direction and parallel to the plantar plane. As shown in the embodiments depicted in FIGS. 1 through 6, this location overlies the lateral ends of bridges 14. This dampener 40 therefore provides cushioning and stability to the decoupled lateral heel, where the foot usually strikes the ground during the gait cycle. Because the lateral heel typically is the initial point of contact between the shoed foot and the ground, this area typically sees the highest impact forces during the gait cycle and the highest deformations of the cushioning medium. Furthermore, the lateral heel is the most critical zone for achieving stability because heel strike is the stalling point for the gait cycle. If this zone is unstable, it perpetuates instability to the rest of the gait cycle. Impact-absorbing material with dampening properties reduces the forces that can destabilize the foot on heel strike, promoting a stable transition to midfoot, forefoot, and toe-off. Dampener 40 achieves a beneficial result by slowing down and controlling the impact forces to lessen the heel-strike energy spike by spreading the deformation and reformation of the cushioning medium over a longer period of time. In addition, the intended function of the decoupled medial heel is to be a neutral zone that provides a platform for stability, or a firm "posting" platform in the case of an athlete with an anatomical tendency to pronate on the heel-strike to mid-foot transition.

Another variation envisions filling the tunnels 42 with one or more materials having different physical properties from those of the surrounding midsole—that is, to fill the dampener 40 with materials other than air.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. A sole unit for a shoe comprising:

at least one decoupling track between regions of the sole unit allowing for the decoupling of the regions in response to forces from foot-ground contact;

a plurality of bridge elements connecting opposite sides of the track so that when forces from foot-ground contact are alleviated, there is a recoupling of the decoupled regions;

a tendon for controlling force along a defined path in the sole unit and wherein the bridge elements have first ends connected to the tendon, the tendon having at least one section disposed substantially along one side section of the decoupling track and the bridge elements extend from the tendon and are connected to the opposite side of the section of the decoupling track;

and wherein the tendon extends lengthwise along the sole unit from one side of the sole unit in a heel region, across a midfoot region, to an opposite side of the sole unit in a forefoot region.

2. The sole unit according to claim 1 wherein the decoupling track follows a path that creates lateral-medial decoupling of a heel region.

3. The sole unit according to claim 1 wherein the decoupling track follows a path that creates lateral-medial decoupling of a forefoot region.

4. The sole unit of claim 1 wherein the tendon extends along one or more decoupling tracks in a heel region and a forefoot region.

5. The sole unit of claim 4 wherein the shoe includes one or more tendons with extending bridge elements and at least one tendon comprises a curvilinear element that follows one or more curvilinear decoupling tracks disposed substantially longitudinally in at least a heel region or forefoot region.

6. The sole unit of claim 1 wherein a tendon element and one or more associated decoupling tracks are disposed in at least a heel region and a forefoot region and decouple the heel and forefoot regions into lateral and medial sides.

7. The sole unit of claim 6 wherein the tendon is disposed on a lateral side of the heel.

8. The sole unit of claim 7 wherein the tendon is disposed on a medial side of the forefoot.

9. The sole unit of claim 6 wherein the bridge elements extend across the decoupling track and connect to a medial side of the heel region.

10. The sole unit of claim 3 wherein the decoupling track comprises a groove in the sole unit.

11. The sole unit of claim 1 wherein the tendon and/or bridge elements are made from one of TPU, TPR, BASF Elastalon, Hytrel, Pebax, PVC, Nylon and its derivatives, and rubber and its synthetic and natural derivatives.

12. The unit of claim 11 wherein the tendon and bridge elements are disposed between layered portions of a midsole and an outsole.

13. The sole unit of claim 11 wherein the midsole portion is selected from a material or structure comprising one or more of EVA, Polyurethane, and a fluid filled compartment, and wherein the outsole material comprises a rubber or an elastomer.

14. The sole unit of claim 6 further comprising a dampening element associated with at least one of the decoupled sole unit regions.

15. The sole unit of claim 1 wherein the bridge elements are elastic relative to the sole unit regions.

16. The sole unit of claim 1 wherein the bridge elements are inelastic relative to the sole unit regions.

17. A sole unit comprising:

at least one decoupling groove provided in the sole unit; and at least one tendon having a plurality of extending bridge elements elastically connecting opposite sides of the decoupling groove; and wherein the tendon extends lengthwise along the sole unit from one side of the sole unit in a heel region, across a midfoot region, to an opposite side of the sole unit in a forefoot region.

18. The sole unit of claim 17 in which the tendon elastically connects the rearfoot with the forefoot.

19. The sole unit of claim 17 in which the tendon elastically connects the rearfoot with the midfoot.

20. The sole unit of claim 17 in which the tendon elastically connects the midfoot with the forefoot.

21. The sole unit of claim 17 in which the tendon is a separate piece of elastomeric material affixed to a portion of an outsole, a midsole, or both.

22. The sole unit of claim 17 in which the tendon is an integral part of an outsole or a midsole.

23. The sole unit of claim 17 wherein the decoupling grooves separate the lateral heel from the medial heel.

24. The sole unit of claim 17 wherein the decoupling grooves separate the lateral midfoot from the medial midfoot.

25. The sole unit of claim 17 wherein the decoupling grooves separate the lateral forefoot from the medial forefoot.

26. The sole unit of claim 17 additionally comprising at least one dampening element associated with the tendon at a decoupled region.

27. A method of making a sole unit for a shoe comprising:

providing a sole unit and configuring the sole unit with at least one decoupling track between regions of the sole unit allowing for the decoupling of the regions in response to forces from foot-ground contact and configuring the sole unit to have a plurality of bridge elements connecting opposite sides of the track so that when forces from foot-ground contact are alleviated, there is a recoupling of the decoupled regions;

providing the sole unit with a tendon associated with a side of a decoupling track, the bridge elements extending from the tendon across to the opposite side of the decoupling track; and wherein the tendon extends lengthwise along the sole unit from one side of the sole unit in a heel region, across a midfoot region, to an opposite side of the sole unit in a forefoot region.

28. A shoe comprising:

a sole unit attached to an upper, the sole unit having at least one decoupling track between regions of the sole unit allowing for the decoupling of the regions in response to forces from foot-ground contact;

a plurality of bridge elements connecting opposite sides of the tack so that when forces from foot-ground contact are alleviated, there is a recoupling of the decoupled regions;

a tendon for controlling force along a defined path in the sole unit and wherein the bridge elements have first ends connected to the tendon, the tendon having at least one section disposed substantially along one side section of the decoupling track and the bridge elements extend from the tendon and are connected to the opposite side of the section of the decoupling track; and wherein the tendon extends lengthwise along the sole unit from one side of the sole unit in a heel region, across a midfoot region, to an opposite side of the sole unit in a forefoot region.

29. A sole unit for a shoe, comprising a sole unit having a decoupling track between regions of sole unit allowing for the decoupling of the regions in response to forces from foot-ground contact; and a tendon for control of forces along at least a section of the decoupling track; and wherein the tendon extends lengthwise along the sole unit from one side of the sole unit in a heel region, across a midfoot region, to an opposite side of the sole unit in a forefoot region.

* * * * *